United States Patent [19]

Ochiai et al.

[11] 4,441,828

[45] Apr. 10, 1984

[54] PRINTING HEAD OF DOT PRINTER

[75] Inventors: Kuniaki Ochiai; Masami Horii; Osamu Aoki, all of Shizuoka, Japan

[73] Assignee: Tokyo Electric Co., Ltd., Tokyo, Japan

[21] Appl. No.: 324,649

[22] Filed: Nov. 24, 1981

[30] Foreign Application Priority Data

Dec. 5, 1980 [JP] Japan ..... 55-171852
Feb. 16, 1981 [JP] Japan ..... 56-21676

[51] Int. Cl.[3] ..... B41J 3/12
[52] U.S. Cl. ..... 400/124; 101/93.05
[58] Field of Search ..... 400/124; 101/93.05; 29/602 R

[56] References Cited

U.S. PATENT DOCUMENTS

| | | | |
|---|---|---|---|
| 4,009,772 | 3/1977 | Glaser et al. | 400/124 |
| 4,156,960 | 6/1979 | Ikeda | 400/124 X |
| 4,211,496 | 7/1980 | Naylor | 400/124 |
| 4,240,756 | 12/1980 | Ku et al. | 400/124 |
| 4,279,521 | 7/1981 | Kightlinger | 400/124 |

*Primary Examiner*—Paul T. Sewell
*Attorney, Agent, or Firm*—Oblon, Fisher, Spivak, McClelland & Maier

[57] ABSTRACT

A spring support which receives one end of a needle spring to urge the needle in a reset direction is free to move forwards or backwards. During assembly the spring support is disposed in the top end direction of the needle such that the needle is stable at the inserting state of the top end in the needle guide, after completion of the assembly the spring support is moved rearwards and fixed, and the needle is supplied with a restoring force by compression of the needle spring.

6 Claims, 17 Drawing Figures

PRINTING HEAD OF DOT PRINTER

BACKGROUND OF THE INVENTION

1. Field of the Invention

The present invention relates to dot printers and more particularly to a printing head of a dot printer.

2. Description of the Prior Art

FIG. 1 shows a conventional example. In the figure, numeral 1 designates a support member provided with a plurality of electromagnets 2. Each electromagnet 2 comprises a coil 4 mounted on a yoke 3 and an armature 5 rotatably mounted thereon. On the support member 1 is mounted a cover 7 on which a stopper 6 is supported to determine the reset position of the armature 5.

A guide holder 8 is attached to the support member 1 using screws 9. In the front surface and the center of the guide holder 8 are fixed needle guides 11, 12 which align a plurality of needles 10 and slidably hold them, and in the rear portion thereof is fixed a plate-shaped spring support 14 which allows the needles to pass through and receives one end of needle springs 13 with coil spring. The other end of each needle spring 13 is contacted with a cap 15 fixed to the rear end of the needles 10. A platen 18 is installed on the front surface of the needle guide 11 and holds a paper 17 opposite a printing ribbon 16. A specific needle slides by means of attracting action of the armature 5, and thus printing is performed.

In assembly, however, before mounting the armature 5 the needles 10 slide by force of the needle springs 13 so that the top end of the needles 10 go back from position C of the needle guide 11 and the rear end further projects backwards from attraction position A of the armature 5, as shown in FIG. 2. It is therefore impossible for all needles 10 to pass through the needle guide 11 and all armatures 5 are held at a pushing state to mount the stopper 6. Accordingly, the armatures 5 must be temporarily fixed one at a time so as to insert the needles 10 in the needle guide 11 and then released from the temporary fixing state after mounting the stopper 6, resulting in a quite troublesome assembly. If one stopper 6 determines the reset position of one armature 5 only, the temporary fixing work of the armature 5 may be omitted. In this conventional example, however, the number of components increases and installation of many stoppers 6 causes the number of assembling steps to increase. If a needle spring 19 having large spring constant is used as shown in FIG. 3, the top end of the needle 10 is pulled out of the needle guide 11 and the rear end moves beyond the attraction position A of the armature 5 by a relatively small amount, thereby facilitating assembly of the armature 5 and the stopper 6. However, as the needles 10 come close to the platen 18 during printing, the load of the needle spring 19 increases significantly. Unless the distance between the needle guide 11 and the platen 18 is not reduced, printing cannot be carried out, an the reduced distance causes the paper 17 to be soiled by the printing ribbon 16. This invention has disadvantages also in that the electromagnet 2 of large capacity is required and the power consumption increases.

SUMMARY OF THE INVENTION

An object of this invention is to facilitate the assembling work of printing head.

Another object of this invention is to enable printing even if the distance between the printing head and the platen is large and to prevent the paper from being soiled by the printing ribbon.

Still another object of this invention is to enable the needle to be driven by the electromagnet of small capacity.

BRIEF DESCRIPTION OF THE DRAWINGS

Various other objects, features and attendant advantages of the present invention wil be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
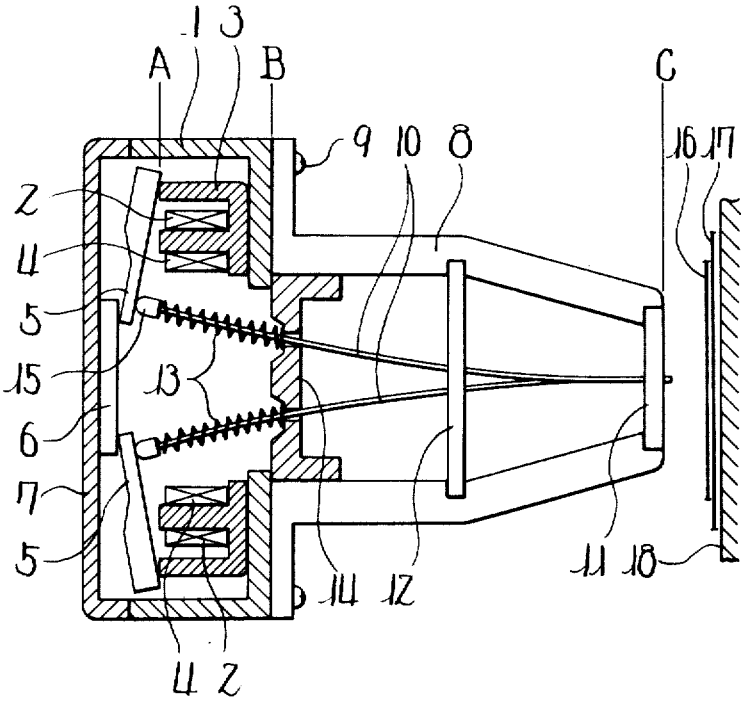
Fig. 1 PRIOR ART
FIG. 1 is a horizontal sectional view of a conventional example.
Figure 2:
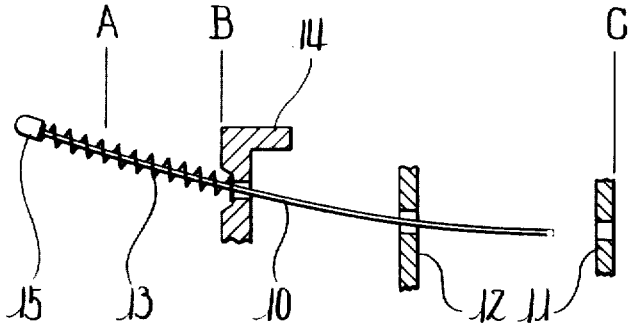
Fig. 2 PRIOR ART
FIGS. 2 and 3 are a partly horizontal sectional view illustrating support structure of a needle spring.
Figure 3:
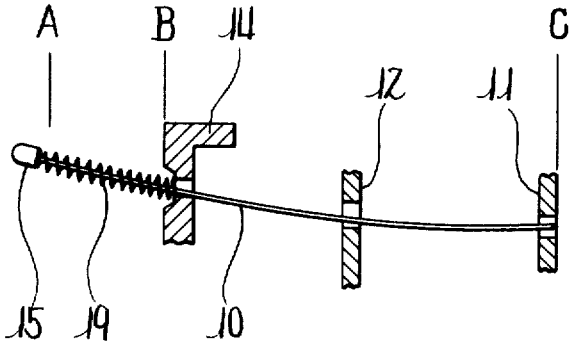
Fig. 3 PRIOR ART

A first embodiment of this invention will now be described referring to FIGS. 4 to 7. In the following description, like elements in FIGS. 1 to 3 are identified by like reference numerals and the detailed description thereof is omitted. A plurality of needles 10 is slidably held, and a disc-shaped spring support 20 which supports one end of each needle spring 13 is slidably held in a longitudinal direction by a guide holder 8. The guide holder 8 is provided with an annular groove 22 which engages a stop ring 21 to fix the spring support 20 at a rear position B.

Figure 4:
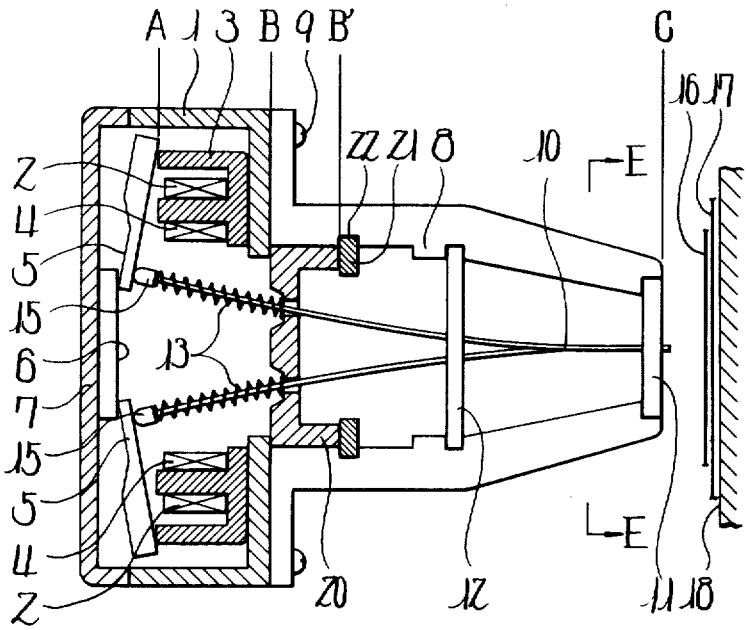
FIG. 4 is a horizontal sectional view of a first embodiment of this invention.
Figure 5:
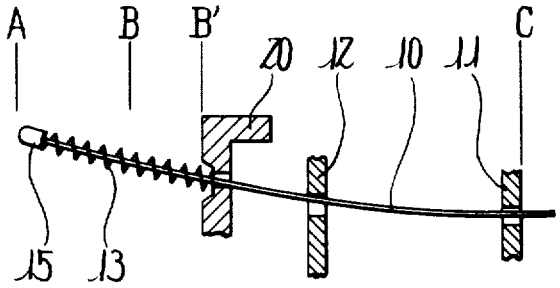
FIG. 5 is a partly horizontal sectional view illustrating a spring support in an advanced state.
Figure 6A:
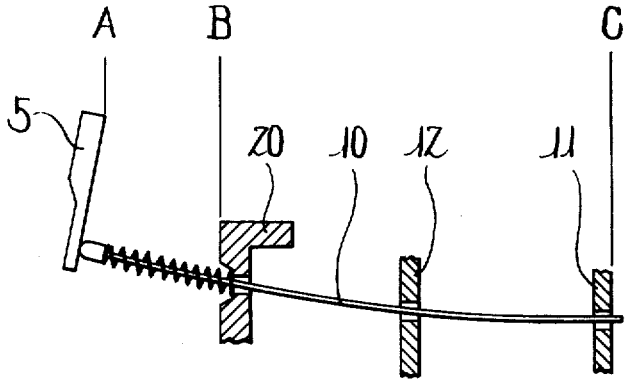
FIGS. 6(*a*) 6(*b*) and 6(*c*) are partly horizontal sectional views illustrating operation of an armature and a needle.
Figure 6B:
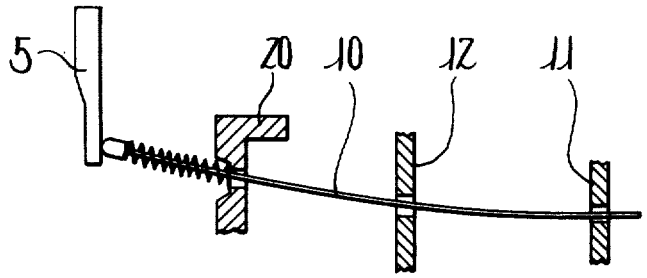
Figure 6C:
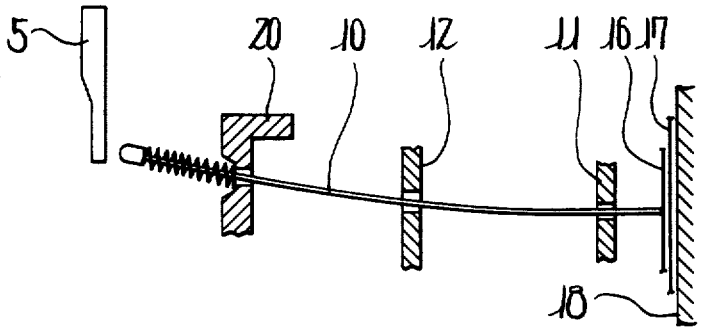
Figure 7:
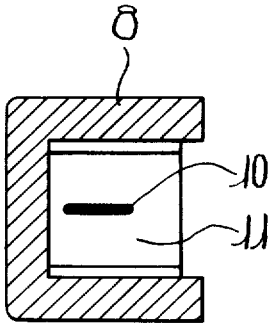
FIG. 7 is a sectional view taken on line E—E of FIG. 4.

In this embodiment, the spring support 20 is advanced towards the platen 18 and needle guide 11 as shown in FIG. 5. When the spring support 20 is axially in advanced position B', the top end of the needle 10 is not pulled out of the needle guide 11, and the rear end of the needle 10 is disposed in front of the attraction position A of the armature 5. Assembly of the armature 5 and the stopper 6 can be carried out easily when the needle 10 is not inserted in the needle guide 11 and without influence of the needle spring 13. Of course, it is possible that a unit is constituted by assembling the electromagnet 2, the stopper 6 and the cover 7 on the support member 1 and the guide holder 8 which moves the spring support 20 in the advanced position B' is connected to the unit using the screws 9. Finally, the spring support 20 is moved to the rear position B and fixed by the stop ring 21 fitted to the groove 22. This state determines the contact force of the needle 10 with respect to the armature 5. This state is shown in FIG. 4 and FIG. 6(*a*). When a specific electromagnet 2 is energized, the armature 5 acts on the attraction position A as shown in FIG. 6(*b*), and the needle 10 is struck by the armature 5 and bends the needle spring 13 and is displaced so as to collide with the platen 18 as shown in FIG. 6(*c*). Since the needle spring 13 does not influence the assembly of the stopper 6, a spring with small spring constant can be used therefore distance between the platen 18 and the top end of the needle 10 may be widened. Accordingly, the paper 17 is not soiled by the printing ribbon 16, and the electromagnet 2 of small capacity can drive the needle 10 so as to save electric power.

Figure 8:
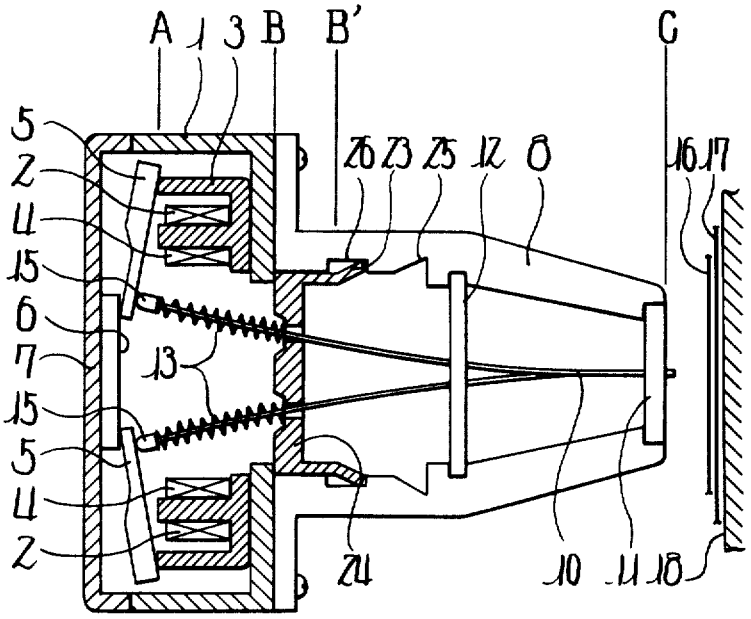
FIG. 8 is a horizontal sectional view of a second embodiment of this invention.
Figure 9:
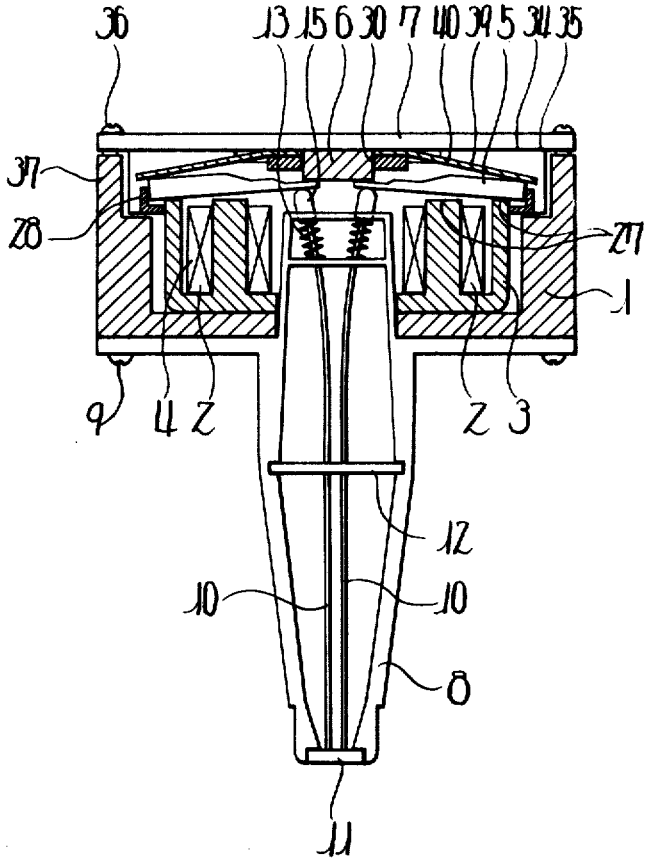
FIG. 9 is a plan view partly in section illustrating another embodiment of armature mounting portion.
Figure 10:
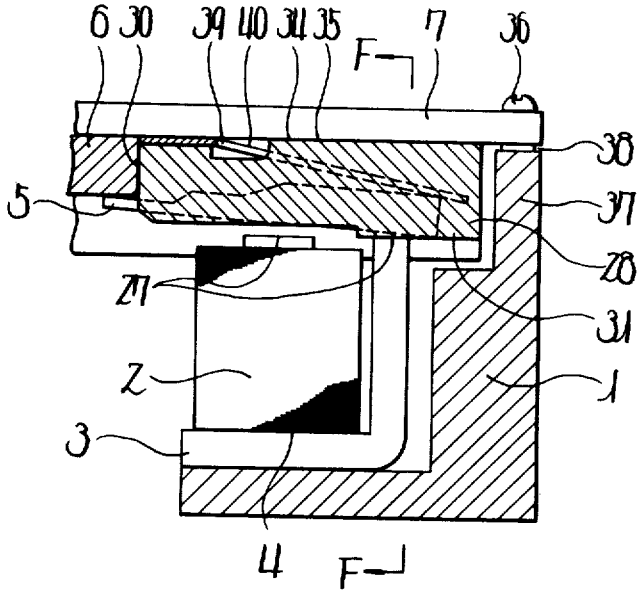
FIG. 10 is an enlarged plan view partly in section of principal part of FIG. 9.
Figure 11:
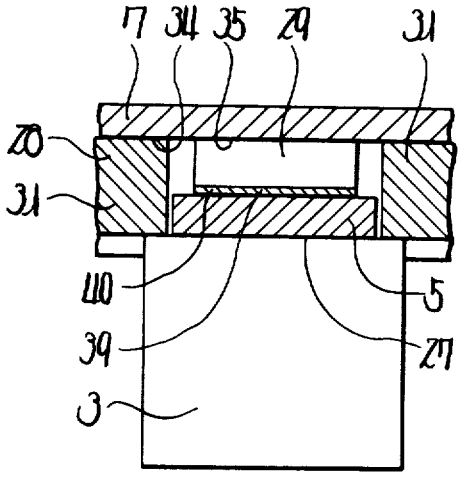
FIG. 11 is a longitudinal sectional side view taken on line F—F of FIG. 10.
Figure 12:
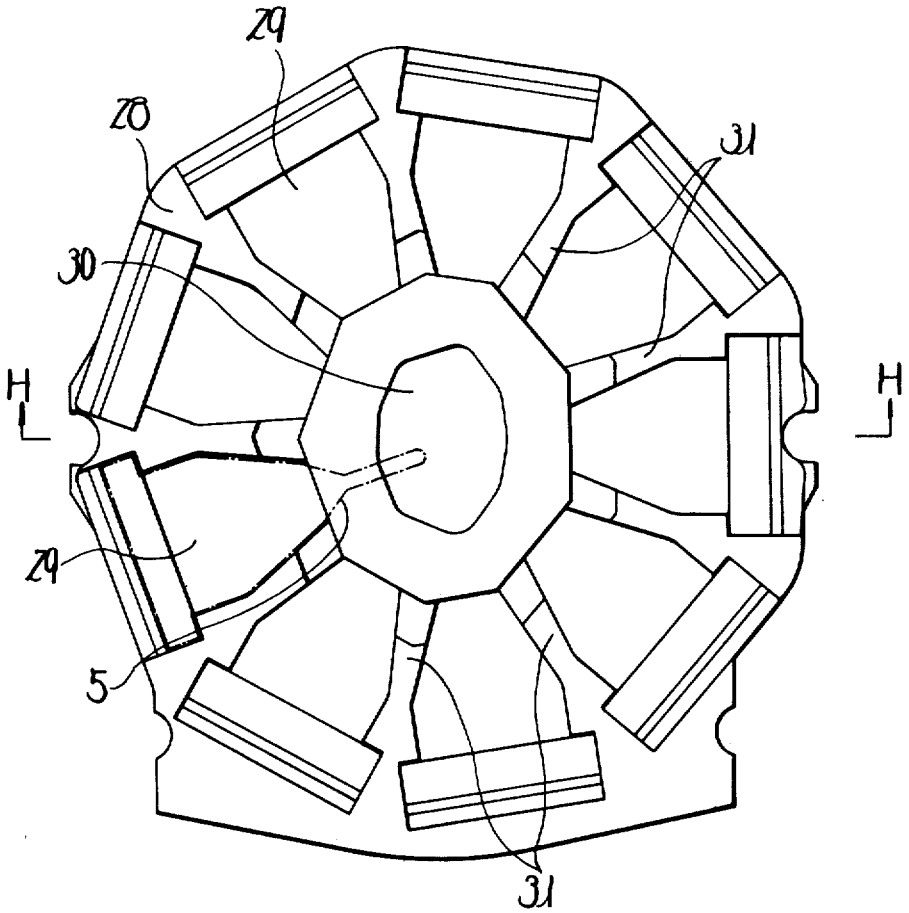
FIG. 12 is an enlarged plan view of a support member.
Figure 13:
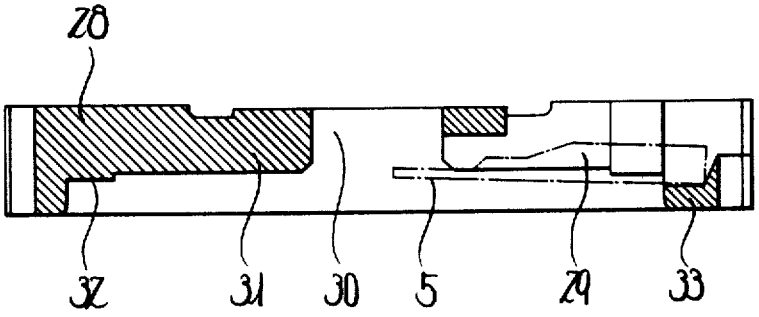
FIG. 13 is a sectional view taken on line H—H of FIG. 12.
Figure 14:
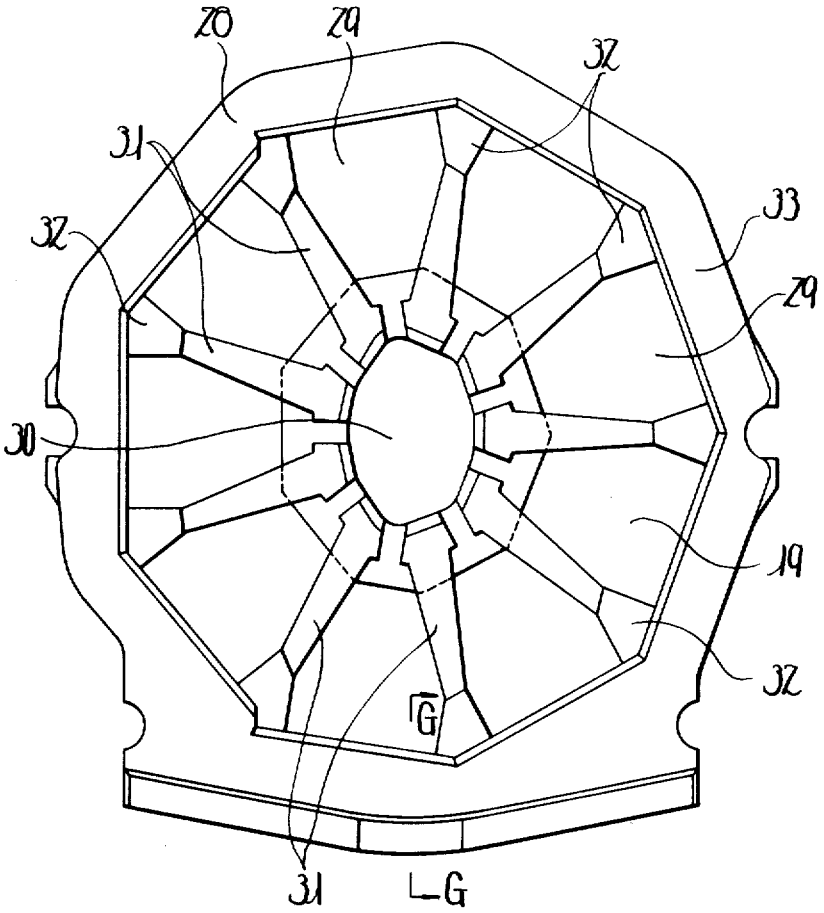
FIG. 14 is an enlarged bottom view of the support member.
Figure 15:
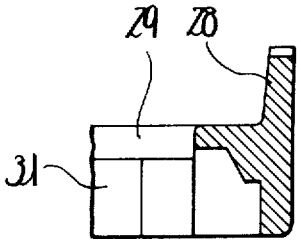
FIG. 15 is a sectional view taken on line G—G of FIG. 14.

A second embodiment of this invention will be described referring to FIG. 8. In this embodiment, a spring support 24 provided with an elastic engaging pawl 23 is installed, and engaging recesses 25, 26 to be engaged with the engaging pawl 23 are formed on the guide holder 8. In assembly, the spring support 24 is advanced and the engaging pawl 23 is engaged with the recess 25 under a spring action. Upon completion of assembly, the engaging pawl 23 is engaged with the engaging recess 26 and the contact force of the needle 10 to the armature 5 is determined. A coil spring used as the needle spring 13 may be tension spring, or the needle spring of leaf spring may be used.

Since this invention is constituted as above described, assembly of the armature and the stopper can be carried out when the spring support is moved forwards and without influence of the needle spring. This invention thereby has the effect that a needle spring having a small spring constant can be used, the distance between the top end of the needle and the platen may be widened, the paper is prevented from being soiled by the printing ribbon, and an electromagnet of small capacity can drive the needle so as to save electric power.

Another embodiment of the armature mounting structure of the present invention will now be described referring to FIGS. 9 to 15. On the support member 1 is fixedly mounted the guide frame 8 which holds a plurality of needles 10 slidable. The support member 1 encloses the yoke 3 with a plurality of electromagnets 2 installed in annular arrangement, and a support 28 is disposed on an attraction surface 27 of the yoke 3. The support 28 is provided with a guide recess 29 which holds the armature 5 opposite the attraction surface 27 and rotatable, and the center of the support 28 is provided with a polygonal hole 30 which slidably holds the stopper 6. The guide recess 29 is divided by a plurality of ribs 31 arranged radially. A pedestal 32 contacting to outer portion of the attraction surface 27 of the yoke 3 is formed on the outer portion of each rib 31, and the outer end of the rib 31 is connected to an annular rib 33 for reinforcement. Outer surface of the support 28 is located a base surface 34 to position the end surface of the stopper 6, and the cover 7 provided with a flat surface 35 contacting the base surface 34 is mounted on a peripheral wall 37 of the support member 1 spaced apart from each other by a gap 38. An armature spring 39 for urging the armature 5 in the reset direction is provided with a plurality of foot portions 40, each contacting to outer portion of the armature 5 in the guide recess 29 of the support 28. The center to which the foot portions 40 join is opened in order to open one surface of the stopper 6.

In addition, the support 28 also supports a thin mica (not shown) interposed between the attraction surface 27 and the armature 5.

In such embodiment, if the electromagnet 2 is excited, the armature 5 is rotated about fulcrum i.e. outer portion of the attraction surface 27 of the yoke 3 which projects from the inner side of the annular rib. Thereby the needle 10 slides for the printing action, and the armature 5 is reset by the armature spring 39 and also the needle 10 is reset by the needle spring 13. The base surface 34 of the support 28 is pushed by the flat surface 35 of the cover 7, and the support 28 is thereby brought into close contact with the attraction surface 27. The stopper 6 is grasped between the extension surface of the flat surface 28 of the cover 7 and the armature 5, and one end of the stopper 6 thereby coincides with the base surface 34. Accordingly, the stroke of the armature 5 is determined based on the distance between the attraction surface 27 and the base surface 34 less the thickness of the stopper 6 and the armature 5. Contrary to conventional example, variation of distance between the attraction surface 27 and the base surface 34 to set the stopper 6 is determined by dimension accuracy in one portion of one component and therefore the factors for variation are quite small. A single product of the stopper 6 and the armature 5 can be easily finished with plate thickness with a small tolerance. In fact the support 28 may be used only by grinding the base surface 34. The stroke of the armature 5 therefore can be determined accurately. Since the guide recess 29 is formed on the support 29, the component to guide rotation of the armature 5 and the component to locate the stopper 6 may be commonly constituted and thus the number of components can be decreased. Furthermore in the assembling work, the bottom of the support member 1 receives the yoke 3, the armature 5 and the armature spring 39 as well as the support 28 to support the stopper 6 contacted in order, and then the cover 7 may be fixed to the support member 1 so as to facilitate assembly. The stopper 6 is held at the center of the support 28 and thus the outer diameter can be reduced. Reduction of the outer diameter enables the ring connecting the rear end of the needle 10 to be reduced and the needle 10 to be led to the needle guide 11 at the top end without bending the needle 10 so much. Accordingly, the needle 10 can slide smoothly. Furthermore capacity of the electromagnet coil 4 may be reduced so as to save electric power.

In addition, since the support 28 is provided with support hole 30 to slidably hold the stopper 6, it is possible to slide the stopper 6 and the position of the stopper 6 relative to the attraction surface 27 is determined by the jig and the stopper 6 is fixed to the determined position by means of an adhesive agent.

Since this embodiment is constituted as above described, the dimension between the attraction surface of the yoke and the stopper mounting surface can have a small tolerance by dimensioning one portion of one component disposed between the mounting surface of the support to the attraction surface and the base surface within the tolerance. Accordingly, variation of stroke of the armature caused by integration of tolerance can be prevented, and assembly can be simplified. Furthermore the flat surface of the cover is contacted with the base surface of the support, and the support is thereby brought into close contact with the attraction surface of the yoke. If the stopper is grasped between the extension surface of the flat surface of the cover contacting to the base surface and the armature, the base surface can be easily set by only grinding one surface of the support. When the support guides rotation of the armature, the component for locating the stopper and the component to guide operation of the armature can be commonly constituted so as to reduce the number of components and further assist assembly.

What is claimed is:

1. A printing head of a dot printer, comprising:
a support member;
a plurality of needle members located in said support member;
a guide holder connected to said support member and including a groove and a stepped portion;
a stop member engageable in said groove;
a plurality of electromagnets mounted in said support member and each of which further comprises a stopper and an armature with a reset position thereof being determined by said stopper;
a needle guide for guiding said needle members driven by said armatures and wherein said needle guide is operatively associated with an end portion of said guide holder; and
a common spring support for supporting one end of each of said needle springs and for urging the needle members in a reset direction wherein said spring support is located at a rear side of said guide holder after assembly and wherein said spring support is positioned in said guide holder so as to be movable forward to a front position defined by said stepped portion or backward during assembly with respect to the guide holder so as to avoid contact of said armature and stopper with said needle springs during assembly and is fixedly installed at a predetermined rear position within said support member after assembly by said stop member engaged in said groove.

2. A printing head of a dot printer according to claim 1, wherein said spring support is positionable in said support member during assembly such that forward or backward movement of the spring support is set so that a top end portion of the needle does not contact with the armature during assembly.

3. A printing head of a dot printer according to claim 1, wherein a free length of the needle springs contacting with the spring support is set so that when the spring support is in said front position the rear end of the needles does not contact with the armature.

4. A printing head of a dot printer, comprising:
a support member;
a plurality of needle members located in said support member;
a guide holder connected to said support member and including first and second recesses;
a plurality of electromagnets mounted in said support member and each of which further comprises a stopper and an armature with a reset position thereof being determined by said stopper;
a needle guide for guiding said needle members driven by said armatures and wherein said needle guide is operatively associated with an end portion of said guide holder; and
a common spring support for supporting one end of each of said needle springs and for urging the needle members in a reset direction wherein said spring support includes an elastic engaging pawl and is located at a rear side of said guide holder after assembly and wherein said spring support is positioned in said guide holder so as to be movable forward to a front position defined by said pawl being engaged in said second of said recesses or backward during assembly with respect to the guide holder so as to avoid contact of said armature and stopper with said needle springs during assembly and fixedly installed at a predetermined rear position within said support member after assembly by said pawl engaging said first of said recesses.

5. A printing head of a dot printer according to claim 4, wherein the spring support is movable from a front position to a rear position, and is immovable from a rear position to a front position during engagement between the engaging pawl and the first engaging guide holder recess and is not released.

6. A method of assembling a printing head for a dot printer having a support member, a guide holder operatively associated with the support member, a needle guide operatively associated with the guide holder, a spring support positionable within said guide holder at a first and second axial position, a plurality of needle springs operatively associated with the spring holder and a plurality of needle members positioned within said needle springs, respectively, and passing through said spring support, and which comprises:
positioning said spring support at said first position within said guide holder, said first position being closer to said needle guide than said second position;
mounting an armature and armature stopper within said support member without contacting said needle springs;
shifting said spring support to said second position; and fixing the position of said spring support within said guide holder at said second position.

* * * * *